United States Patent [19]

Surjaatmadja

[11] 4,262,743

[45] Apr. 21, 1981

[54] DIFFUSER FOR WELLHEAD ISOLATION TOOL

[75] Inventor: Jim B. Surjaatmadja, Duncan, Okla.

[73] Assignee: Halliburton Company, Duncan, Okla.

[21] Appl. No.: 71,903

[22] Filed: Sep. 4, 1979

[51] Int. Cl.[3] ..... E21B 33/03

[52] U.S. Cl. ..... 166/91; 166/202; 166/242

[58] Field of Search ..... 166/90, 91, 86, 80, 166/70, 76, 77, 75 R, 84, 59, 202; 239/589, 591, 601

[56] References Cited

U.S. PATENT DOCUMENTS

| | | | |
|---|---|---|---|
| 1,252,426 | 1/1918 | Gnade | 166/242 |
| 1,983,854 | 12/1934 | Howard et al. | 166/80 |
| 2,672,199 | 3/1954 | McKenna | 166/202 |
| 2,868,512 | 1/1959 | Sease . | |
| 2,887,160 | 5/1959 | De Priester et al. | 166/59 |
| 3,308,880 | 3/1967 | Yetman | 166/70 X |
| 3,469,642 | 9/1969 | Goodwin et al. | 175/393 |
| 3,763,936 | 10/1973 | Menage | 166/90 X |
| 3,926,253 | 12/1975 | Duke | 166/70 X |
| 4,023,814 | 5/1977 | Pitts | 277/181 |
| 4,111,261 | 9/1978 | Oliver | 166/86 |

*Primary Examiner*—Stephen J. Novosad

*Attorney, Agent, or Firm*—Joseph A. Walkowski; John H. Tregoning

[57] ABSTRACT

An improved diffuser for a wellhead isolation tool which employs a combination of angles in its bore. This improvement reduces the incidence of erosion caused by the flow of fluids through the diffuser, in both the well production tubing adjacent the end of the diffuser and in the diffuser itself.

28 Claims, 4 Drawing Figures

DIFFUSER FOR WELLHEAD ISOLATION TOOL

BACKGROUND OF THE INVENTION

It often becomes desirable when producing an oil well, to treat the well to enhance and increase flow, such as by applying an acidic solution to the producing formation under pressure or by applying a hydraulic solution to the formation under extremely high pressure in order to fracture the formation. In the past, it was necessary to "kill" the well by pumping a fluid, typically mud or water, into the well until sufficient hydrostatic pressure was obtained to overcome the pressure of the formation and prevent the blowing out of fluids from the well. The wellhead was then removed, and the necessary treating apparatus tied into the production tubing. After treatment, the well then had to be swabbed to re-institute production. This cumbersome process is superceded by a wellhead isolation system disclosed in U.S. Pat. No. 3,830,304 entitled "Wellhead Isolation Tool and Method of Use Thereof," issued to Alonzo E. Cummins and assigned to Halliburton Company, Duncan, Okla. The apparatus described therein provides means for directly communicating with production tubing without the removal of the wellhead, killing the well, or swabbing the well after treatment. This is accomplished by providing a hollow high pressure mandrel slidably engaged within a high pressure casing, the casing being adapted for sealing contact with the wellhead and the mandrel being adapted for selective sealing engagement with the upper end portion of the production tubing below the wellhead. The mandrel can be extended or retracted for engagement or disengagement with the production tubing without necessitating the removal of the wellhead. The treating fluids can then be supplied to the well through the mandrel directly into the production tubing of the well without subjecting the wellhead to the high pressures in the mandrel and production tubing. When the mandrel is extended in order to supply fluids to the well, the end of the mandrel is inserted within the production tubing.

As fluids, particularly sand-laden fracturing fluids, are pumped into the well through the mandrel of the wellhead isolation tool, serious erosion results at the exit end of the mandrel and on the interior of the production tubing adjacent the end of the mandrel. This erosion is due to a combination of a number of different factors. First, one is dealing with high flow rates utilizing particulate-laden abrasive fluids. Combined with this factor is the creation of turbulence when the fluid exiting the mandrel encounters the necessarily larger inside diameter of the production tubing, and abruptly loses velocity. The tendency of flowing fluids to expand or flare outwardly at and following the point at which lateral constraints on it are removed, such as at the exit end of the diffuser is another contributing factor to erosion. This tendency is further compounded in gel fluids, which have a tendency to swell and flare to an even greater degree, a phenomenon known as "die-swell." Several prior attempts have apparently been made to reduce the effects of the aforesaid phenomena, in the hope of reducing tool and tubing erosion.

U.S. Pat. No. 4,023,814 issued to Charles A. Pitts and assigned to the Dow Chemical Company, discloses a "packer cup assembly," which is coaxially attached to the lower end of the mandrel of a wellhead isolation tool. The exit end of the bore of the packer cup assembly diverges outwardly at an angle of approximately 10° from the axis of the tool. No specific reference is made to the reduction of erosion, if any, that this exit angle produces.

U.S. Pat. No. 4,111,261, issued to Owen Norman Oliver and assigned to Halliburton Company, discloses a "guide nose" at the end of a wellhead isolation tool mandrel, the bore of which diverges from the axis of the tool at a point near its exit end at a gradual and uniform angle of not more than 3° and preferably 2° from the axis of the tool. This divergence is intended to provide a gradual reduction in velocity of fluid flow as the treating fluid approaches the exit end of the guide nose and reaches the production tubing.

The prior art, while possibly reducing tool and tubing erosion, still possesses certain disadvantages, in that erosion at the exit end of the packer cup assembly or guide nose has not been eliminated or reduced to an extent whereby the apparatus can be reliably used on a large volume job, or for more than one treatment without replacement of the packer cup assembly or guide nose. Furthermore, erosion of the production tubing adjacent the exit point of the fluid from the wellhead isolation tool has not been consistently reduced to a level whereby the operator is assured, particularly when multiple treatments are to be employed, that the tubing is not dangerously eroded. This problem is particularly serious in view of the fact that there is no practical way to inspect the production tubing and determine the possible extent of erosion from each treatment; a failure in the production tubing exposes the wellhead and valve assembly, usually rated at no more than 10,000 PSI, to pressures often in excess of 20,000 PSI without prior warning and with disasterous consequences. Even if the wellhead withstands the sudden pressure increase, the severed string of production tubing may drop down the well. With increased emphasis on well treatment due to the gradual but steady depletion of production from existing wells, the ability for the operator to assure himself that treatment can be effected safely and expeditiously, an assurance which the prior art has not been able to give, becomes of paramount importance.

In contrast, the present invention overcomes the disadvantages and limitations of the prior art by providing a guide nose, preferably referred to as a "diffuser," which markedly reduces both tool and tubing erosion to a minimum. The present invention contemplates a diffuser for attachment to the lower end of a wellhead isolation tool mandrel, the diffuser having a bore coaxial with that of the mandrel. The diameter of the upper portion of the bore of the diffuser is equal to that of the mandrel, and the diameter of the lower portion at its point of exit from the diffuser is only slightly less than the interior diameter of the upper end portion of the oil well production tubing. The bore between the upper portion and the lower portion at its exit point initially diverges at a gradual and uniform rate to a point prior to the exit end, after which it may maintain a constant diameter, converge at a gradual and uniform rate, or initially maintain a constant diameter for an axial distance and than converge at a gradual and uniform rate.

The initially diverging portion of the diffuser bore flares outwardly in a downward (as the tool is installed on the wellhead) direction from the axis of the diffuser for a distance along the bore. At that point, in one embodiment, the bore may then maintain a constant diameter to its lower, or exit, end. Alternatively, the bore may initially diverge as previously stated, and then converge at a "negative angle" to the axis of the diffuser, this convergence continuing to the exit end. In a third embodiment, the bore may diverge for a distance, then remain constant for a second distance, finally converging to the exit end.

The diffuser possesses seal means on its exterior for fluid sealing with the inside of the production tubing, such seal means being more fully described in copending U.S. patent application Ser. No. 065,654 filed on Aug. 10, 1979 and entitled "Seal System for Wellhead Isolation Tool Diffuser" by Thomas J. Luers and Richard L. Giroux. This fluid seal of course, isolates the high pressure in the production tubing from the relatively low-strength wellhead and valve assembly.

The aforementioned combinations of diffuser bore angles significantly reduce tool and tubing erosion by providing a gradual transition in fluid velocity from the diffuser to the production tubing, and stabilizing the velocity in the case of the constant or 0° exit configuration, while in the embodiments which utilize a negative exit angle, the fluid is actually being re-accelerated as it leaves the end of the diffuser. Both a 0° exit angle and a negative angle serve to reduce turbulence in the fluid, and counter the tendency of a fluid to flare upon exit from the diffuser, as well as the die-swell phenomenon inherent in gels, thus reducing or eliminating the damaging erosion which is the result of these phenomena.

DESCRIPTION OF THE PREFERRED EMBODIMENTS

Figure 1:
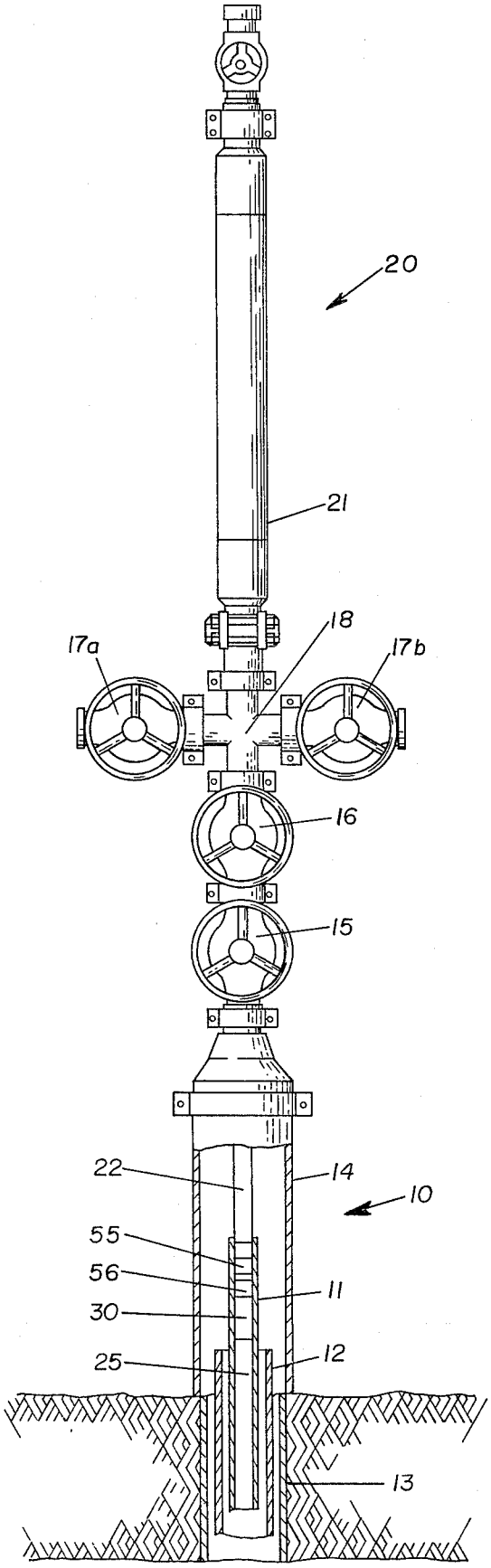
FIG. 1 illustrates a schematic drawing of a wellhead isolation tool after it has been actuated and the diffuser has been placed within the upper end of the production tubing.

Referring now to the drawings, and to FIG. 1 in particular, a normal producing well with wellhead isolation tool mounted thereon is schematically illustrated at 10. The well comprises casing 12 passing into the ground, ground casing 13 located concentrically around casing 12, and production tubing 11 passing concentrically within casings 12 and 13. Located above ground and mounted to ground casing 13, is the wellhead 14 having thereon a lower valve 15, intermediate valve 16, and a tee 18 including wing valves **17*a* and 17*b*. Mounted on the wellhead 14 is wellhead isolation tool 20 of the type disclosed in U.S. Pat. No. 3,830,304, referred to previously. The tool 20 comprises a tubular cylindrical housing 21 constructed of substantially strong material rated to withstand pressures in excess of 20,000 PSI. Located concentrically and slidably within housing 21 is a high pressure mandrel 22 which is a tubular cylindrical member extending completely through housing 21 above and below the housing. Attached to the lower end of mandrel 22 is diffuser 30 having thereon cup-shaped sealing means 55 and 56. Treating fluid enters production tubing 11 at bore area 25 from diffuser 30**.

Figure 2:
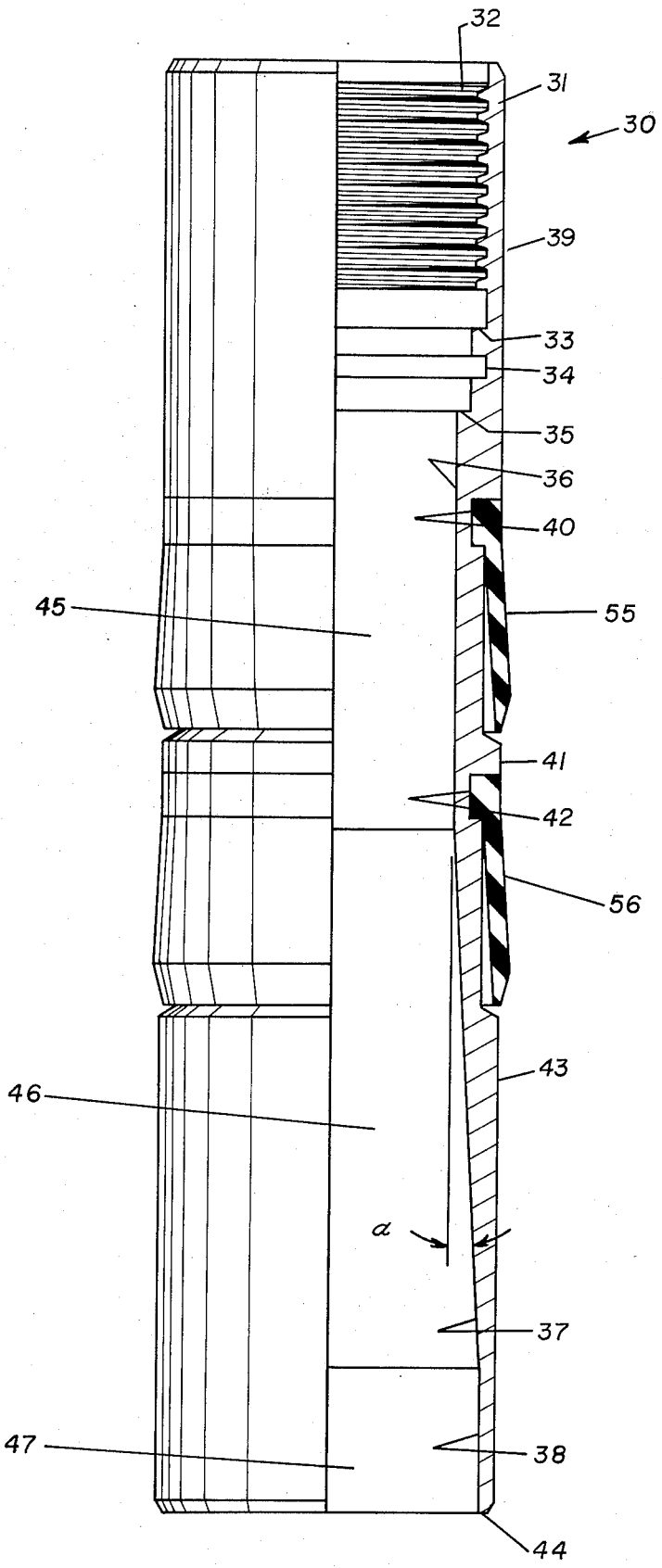
FIG. 2 is a partial cross-sectional view of the wellhead isolation tool diffuser of the present invention.

Referring now to FIG. 2 of the drawings, a detailed description of the wellhead diffuser of the present invention is disclosed therein. Upper end portion 31 of diffuser 30 contains interior threads 32 for attachment to mandrel 22. Below threads 32 on the interior of diffuser 30 are located shoulders 33 and 35, the latter of which abuts against a corresponding mating portion of mandrel 22 when threadably attached thereto. Intermediate shoulders 33 and 35 is located annular groove 34, wherein an annular seal (not shown) is located to provide a fluid-tight seal between diffuser 30 and mandrel 22. The upper bore 45 of diffuser 30 is equal to that of mandrel 22 while the lower bore 47 of diffuser 30 is only slightly less than the inner diameter of production tubing 11. Between upper bore 45 and lower bore 47 is located intermediate bore 46, which has a diameter equal to upper bore 45 at its upper end, and lower bore 47 at its lower end, the inner diameter of intermediate bore 46 diverging gradually and uniformly therebetween, comprising a frusto-conical passage.

The exterior of diffuser 30 has outer surfaces 39, 41 and 43 of a diameter equal to that of mandrel 22. Between outer surfaces 39 and 41, and again between outer surfaces 41 and 43, the surface of the mandrel possesses identical stepped circumferential grooves 40 and 42, respectively. Cup seals 55 and 56, which are identical, are accommondated in grooves 40 and 42, respectively, with the upper, thick-walled portion of each cup being of substantially the same axial length as the axial width of the deeper portion of each groove, thereby fitting in mating engagement therewith. Cup seals 55 and 56 are of elastomeric composition, and are stretched over diffuser 30 to the point where each seal contracts into its respective groove. Below outer surface 43 of diffuser 30 is end surface 44, which is inwardly beveled to a flat end adjacent lower bore 47.

As stated previously, upper bore 45 of diffuser 30 is of the same diameter as that of the wellhead isolation tool mandrel 22, thereby comprising a cylindrical passage. Upper bore 45 is defined by sidewall 36, which maintains a constant radial distance from the axis of diffuser 30. Below and contiguous with upper bore 45 and sidewall 36 (as the tool is installed on the wellhead) are intermediate bore 46 and sidwall 37. Intermediate bore 46 comprises a frusto-conically shaped divergent passage which increases in diameter as it extends in a downward direction. Intermediate bore 46 is defined by sidewall 37, which gradually and uniformly diverges from the axis of the diffuser 30 at an angle $\alpha$ which is preferably not more than approximately 3°. Described in a different manner, the frusto-conical shape of intermediate bore 46 has a preferred apical angle of not more than approximately 6°. Below and contiguous with intermediate bore 46 and sidewall 37 are lower bore 47 and sidewall 38. Lower bore 47 comprises a cylindrical passage, defined by sidewall 38, which maintains a constant radial distance from the axis of diffuser 30. Lower bore 47 communicates with end surface 44, thereby providing a straight, or 0° exit from the diffuser 30. The angle of divergence $\alpha$ of intermediate bore 46 provides a very gradual, uniform increase in bore cross-section, with a consequent gradual, uniform decrease in fluid velocity as it travels through the bore. As fluid reaches the lower end of intermediate bore 46, it enters lower bore 47, which is of only slightly less diameter than the interior of production tubing 11. The constant interior diameter of lower bore 47 then stabilizes the velocity of the fluid prior to its entry into bore area 25 of production tubing 11. As the transition of the fluid from lower bore 47 into bore area 25 of production tubing 11 involves only a slight increase in the diameter of the walls constraining the treating fluid, the fluid's velocity is not slowed appreciably, and the tendency toward turbulence is greatly lessened. The flare and die-swell effects of the fluid as it enters bore area 25 are also necessarily reduced, due to the prior velocity stabilization achieved by lower bore 47 and the limited distance the fluid has in which to expand, due to the reduced difference in inside diameters between lower bore 47 and production tubing 11.

Figure 3:
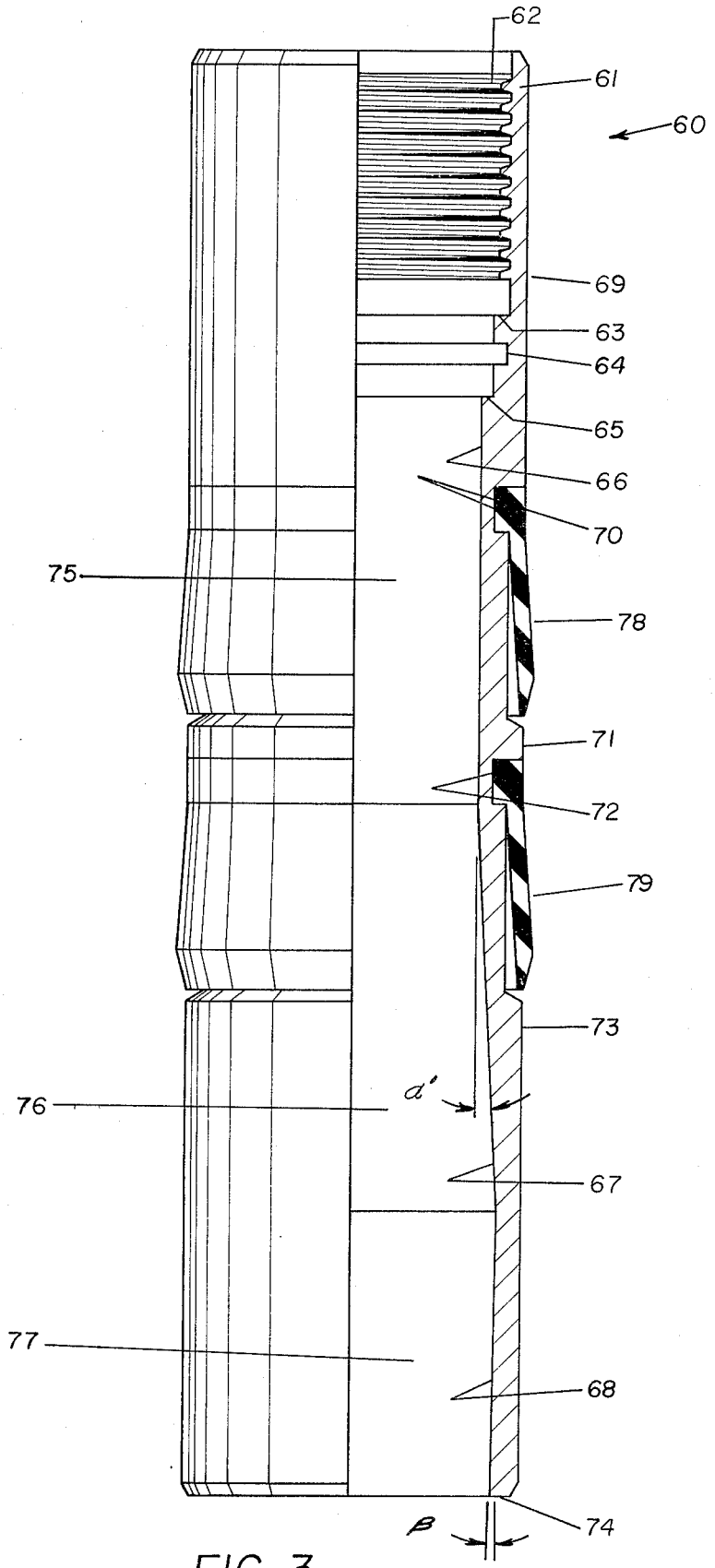
FIG. 3 is a partial cross-sectional view of a second embodiment of the wellhead isolation tool diffuser of the present invention.

Referring now to FIG. 3, a second embodiment of the improved diffuser of the present invention is disclosed therein. In lieu of diffuser 30, modified diffuser 60 may be employed at the lower end of mandrel 22. The exterior and seal means of diffuser 60 are substantially the same as that of diffuser 30. Upper end portion 61 of diffuser 60 contains interior threads 62 for attachment to mandrel 22. Below threads 62 on the interior of diffuser 60 are located shoulders 63 and 65, the latter of which abuts against a corresponding mating portion of mandrel 22 when threadably attached thereto. Intermediate shoulders 63 and 65 is located annular groove 64, wherein an annular seal (not shown) is located to provide a fluid-tight seal between diffuser 60 and mandrel 22. The exterior of diffuser 60 has outer surfaces 69, 71 and 73 of a diameter equal to that of mandrel 22. Between outer surfaces 69 and 71, and again between outer surfaces 71 and 73, the surface of the mandrel possesses identical stepped circumferential grooves 70 and 72, respectively, into which identical cup seals 78 and 79 fit in mating engagement therewith in the manner heretofore described with respect to cup seals 55 and 56 of diffuser 30. As with cup seals 55 and 56, cup seals 78 and 79 are formed of an elastomeric material. Below outer surface 73 of diffuser 60 is end surface 74, which is inwardly beveled to a flat end adjacent lower bore 47.

As in the diffuser 30, upper bore 75 of diffuser 60 is of the same diameter as that of the wellhead isolation tool mandrel 22, thereby comprising a cylindrical passage. Upper bore 75 is defined by sidewall 66, which maintains a constant radial distance from the axis of diffuser 60. Below and contiguous with upper bore 75 and sidewall 66 are intermediate bore 76 and sidewall 67, which again are similar to intermediate bore 46 and sidewall 37 of diffuser 30, in that bore 76 comprises a frusto-conically shaped divergent passage, which passage is defined by sidewall 67, the latter gradually and uniformly diverging in a downward direction from the axis of the diffuser 60 at an angle $\alpha'$ of preferably not more than approximately 3°. The frusto-conical passage, therefore, possesses an apical angle of not more than approximately 6°. Below and contiguous with intermediate bore 76 and sidewall 67 are lower bore 77 and sidewall 68. Unlike lower bore 47 of diffuser 30, lower bore 77 does not comprise a cylindrical passage, but an inverted frusto-conical passage, which is defined by sidewall 68. Sidewall 68 gradually and uniformly converges toward the axis of diffuser 60 in a downward direction at an angle $\beta$ communicating with end surface 74, thereby providing a converging, or negative angle, exit from diffuser 60. With an intermediate bore angle $\alpha'$ of approximately 3°, it is preferred that the lower bore angle $\beta$ be not more than approximately $-0.5°$. If a lesser angle $\alpha'$ is utilized in intermediate bore 76, angle $\beta$ in lower bore 77 may be increased, it being desirable in all instances to assure a relatively smooth transition from diverging intermediate bore 76 to converging lower bore 77.

As with diffuser 30, diverging angle $\alpha'$ of intermediate bore 76 provides a very gradual, uniform increase in bore cross-section, with a consequent gradual, uniform decrease in fluid velocity as it travels through the bore. As fluid reaches the lower end of intermediate bore 76, it enters lower bore 77 which converges at angle $\beta$. As the fluid travels through lower bore 77, it is reaccelerated by virtue of the gradual decrease in cross-section, and the convergence of lower bore 77 serves to balance the flare and die-swell tendencies of the fluid. As a result, when the fluid enters bore area 25 of production tubing 11, its tendency to flare or die-swell is curbed, the redirection of the fluid prior to entering bore area 25 reduces the tendency toward particulate matter impinging on the tubing wall, and the transition from the bore diameter of mandrel 22 to that of production tubing 11 is effected with minimum disturbance of flow by virtue of the gradual increase of diameter effected by intermediate bore 76 which increase, of course, exceeds the subsequent decrease effected by lower bore 77.

Figure 4:
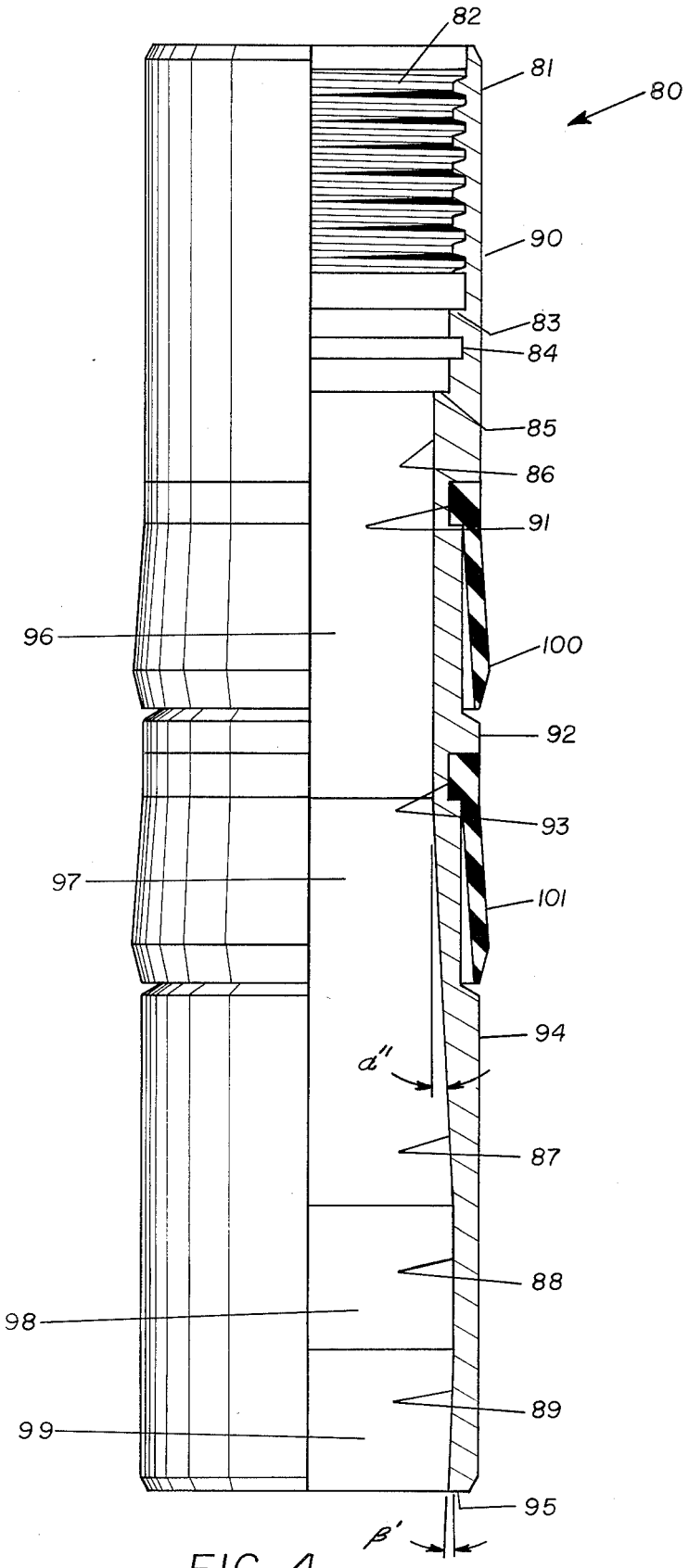
FIG. 4 is a partial cross-sectional view of a third embodiment of the wellhead isolation tool diffuser of the present invention.

Referring now to FIG. 4, a third embodiment of the improved diffuser of the present invention is disclosed therein. In lieu of the configuration of diffusers 30 or 60, diffuser 80 may be employed with mandrel 22. The exterior and seal means of diffuser 80 is substantially the same as those of diffusers 30 and 60. Upper end portion 51 of diffuser 80 comprises interior threads 82, shoulders 83 and 85, and annular groove 84, all of which correspond to similar features on diffusers 30 and 60. The exterior of diffuser 80 possesses outer surfaces 90, 92 and 94, of a diameter equal to that of mandrel 22, as well as identical stepped circumferential grooves 91 and 93 wherein identical elastomeric cup seals 100 and 101 fit in mating engagement in the manner previously described with respect to diffusers 30 and 60. End surface 95, below outer surface 94, is beveled to a flat end adjacent lower bore 99.

As in diffusers 30 and 60, upper bore 96 of diffuser 80 is of the same diameter as that of mandrel 22, thereby comprising a cylindrical passage, defined by sidewall 86, which maintains a constant radial distance from the axis of diffuser 80. Below and contiguous with upper bore 96 and sidewall 86 are intermediate bore 97 and sidewall 87, which are similar to intermediate bores 46 and 76, and sidewalls 37 and 67, respectively. Intermediate bore 97 comprises a frusto-conically shaped divergent passage, which passage is defined by sidewall 87, the latter gradually and uniformly diverging in a downward direction from the axis of diffuser 80 at an angle $\alpha''$ of preferably no more than approximately 3°; the preferred apical angle of the frusto-conical passage being not more than approximately 6°. Below and contiguous with intermediate bore 97 and sidewall 87 are second intermediate bore 98 and sidewall 88. Second intermediate bore 98 comprises a cylindrical passage, defined by sidewall 88, which maintains a constant radial distance from the diffuser axis. Below and contiguous with second intermediate bore 98 and sidewall 88 are lower bore 99 and sidewall 89. Lower bore 99 comprises an inverted frusto-conical passage, defined by sidewall 89, which converges at a gradual and uniform rate toward the diffuser axis at a negative angle $\beta'$. Second intermediate bore 98, with its constant cross-section, permits a stabilization of fluid velocity prior to its entrance into lower bore 99, so that, unlke the embodiment of diffuser 60 illustrated in FIG. 3, the converging angle of the lower bore may be increased. With an angle $\alpha''$ of approximately 3°, it is preferred that the anlge $\beta'$ of lower bore 99 not exceed approximately $-1.0°$. If a lesser angle $\alpha''$ is employed in first intermediate bore 97, angle $\beta'$ in lower bore 77 may be increased, it being desirable in all instances to assure a relatively smooth transition from diverging first intermediate bore 97 to straight second intermediate bore 98 to converging lower bore 99.

Angle $\alpha''$ of first intermediate bore 97 provides a very gradual uniform increase in bore cross-section with a consequent gradual, uniform decrease in fluid velocity. As fluid reaches second intermediate bore 98, its velocity is stabilized by the uniform cross-section, after which it is re-accelerated by lower bore 99 which converges at angle $\beta'$. The presence of second intermediate bore 98 permits a greater angle of convergence in lower bore 99, thereby resulting in a greater re-acceleration and balancing of the flare and die-swell tendencies of the fluid. When fluid reaches bore area 25 of production tubing 11, it has been boosted in velocity, its flare and die-swell tendencies have been reduced by the convergence of lower bore 99, and the diameter difference between the bore of mandrel 22 and production tubing 11 has been minimized by divergent first intermediate bore 97, which increase exceeds the subsequent reduction effected by convergent lower bore 99.

Referring now to FIGS. 1 and 2, operation of the apparatus will be described in more detail. As mandrel 22 is inserted into production tubing 11 by a downward movement, diffuser 30 (or alternatively, 60 or 80) is on the lower end of mandrel 22. The beveled surface of lower end 44 facilitates the entry of diffuser 30 into tubing 11 by providing an angled surface which will tend to align the diffuser 30 concentrically within production tubing 11. After end 44 has entered the tubing 11, the mandrel 22 is further lowered until cup seals 55 and 56 are within tubing 11. The elastomeric qualities and divergent lower wall of cup seals 55 and 56 tend to compensate for irregularities in the interior of tubing 11. If desired, fluid may be pumped into the tubing 11 along the outside of diffuser 30, thereby tending to collapse outer walls 64 of cup seals 55 and 56, narrowing the diameter of the seals to that of the exterior of diffuser 30 and facilitating insertion. After insertion of diffuser 30, well 10 is then pressurized by the introduction of fluid under high pressure through mandrel 22 into production tubing 11. Prior to the introduction of fluid into production tubing 11, cup seals 55 and 56 and may be set against the walls of the production tubing 11 by release of pressure on the backside of the seals, effected by opening wing valve 17*a* or 17*b*. In any event, as the high pressure fluid is introduced into the tubing 11 below cup seals 55 and 56, the pressure within tubing 11 becomes greater than that inside of wellhead 14. The pressure differential results in fluid being moved upward between mandrel 22 and the inside of production tubing 11. The lower walls of cup seals 55 and 56 are then forced outward tightly against the tubing wall and in conjunction with the thicker upper walls of the seals bridge the gap between production tubing 11 and diffuser 30. Thus, fluid-tight seals are effected at the junctions of the tubing wall and cup seals, and the cup seals and diffuser. It should be understood that the disclosure of plural cup seals is not to be construed as an indication that two cup seals are necessary for an effective fluid seal. In fact, an adequate seal can be effected by the use of one cup seal. Due to the possibility of damage in handling the diffuser prior to use, and of damaging a seal during insertion into the production tubing, and to the extremely high pressures encountered with the use of a wellhead isolation tool, however, it is expedient to incorporate a redundant double-seal design into the diffuser to ensure a proper fluid seal under all conditions. Subsequent to the setting of seals 55 and 56, treating fluid is pumped through mandrel 22, then diffuser 30 and into production tubing 11.

Utilizing the present invention, in any of its embodiments, much greater flow velocities and hence volumes can be employed than was heretofore possible with prior art devices. As time is at a premium in all well operations, and equipment onsite is generally leased according to total time, cost savings are naturally effected. Furthermore, the magnitude of the treatment to which the well is subjected is greatly increased without the previous fear of tool or tubing failure due to erosion after large volumes of fluid have been injected into the well. This is advantageous both from cost and safety standpoints, as well blowouts have previously resulted from erosion of the production tubing. Multiple treatments without changing diffusers are also now possible, with changing of the cup seals at most if they are damaged from improper insertion or withdrawal from the production tubing. In addition, from the operator's standpoint, the long life of the diffuser itself due to the minimization of erosion damage presents a cost savings.

The embodiment of the present invention which is employed on a particular well is dependent upon the type fluid employed, flow rate, and diameter of production tubing and mandrel, as well as the length of stroke of the wellhead isolation tool. Obviously, with a fluid that has greater flare and die-swell tendencies, a greater counter-balancing of these forces is necessary. With other fluids, less flare and die-swell balancing and fluid re-acceleration may be necessary. In each of the preferred embodiments, the angles $\alpha$, $\alpha'$, and $\alpha''$, and $\beta$ and $\beta'$ can be adjusted, it being noted of course that while angles $\alpha$, $\alpha'$ or $\alpha''$ can be decreased to 2° or even 1°, this results in a much longer diffuser, which may be impractical due to limitations on the length of the mandrel stroke. The same considerations also apply to angles $\beta$ and $\beta'$, in that while a gradual re-acceleration is the most desirable, the tool will become too long if too small a negative angle is employed. However, the choice of embodiments as well as the angles employed within the individual embodiments are a matter of choice and well within the ability of one of ordinary skill in the art.

Thus, although several preferred embodiments of the present invention have been described in the detailed description above, the description is not intended to limit the invention to the particular forms or embodiments discussed herein since they are recognized as illustrative rather than restrictive, and it would be obvious to those skilled in the art that the invention is not so limited. For example, it would be obvious from this disclosure to form the diffuser as an integral part of the mandrel. Similarly, the effectiveness of the bore configuration is not dependent on the configuration of the sealing means. It would be obvious to apply the present invention to applications other than wellhead isolation tools, as it could be employed wherever injection of a fluid from one conduit into another is desired and turbulence or erosion is a problem.

Thus, the invention is declared to cover all changes and modifications of the specific example of the invention herein disclosed for purposes of illustration, which do not constitute departures from the spirit and scope of the invention.

What is claimed is:

1. In an apparatus for providing fluid communication between a source of high pressure fluid and the interior of the upper end portion of the production tubing of an oil well, while isolating the wellhead from said high pressure fluid, the apparatus being of the type which includes: elongated tubular housing means defining a bore therethrough for connection in fluid communication with the interior of the wellhead; elongated tubular mandrel means defining a bore therethrough, concentrically positioned within said elongated tubular housing means in movable sealing engagement therewith, a portion of said mandrel being adapted to extend below said elongated tubular housing means; means for moving said mandrel means within said elongated tubular housing means to extend said inner mandrel means downwardly through said elongated tubular housing means into said production tubing and alternately, to extend said mandrel means upwardly through said elongated tubular housing means and diffuser means disposed at the lower end of said mandrel means, said diffuser having seal means disposed thereabout to provide a fluid seal between said mandrel means and said production tubing the improvement comprising:

bore means within said diffuser means, said bore means being axially aligned with the bore of said mandrel means, said bore means comprising an upper bore, an intermediate bore and a lower bore;

said upper bore being contiguous with said mandrel means bore and comprising a cylindrical passage defined by a sidewall parallel to the axis of said diffuser means, said upper bore having a diameter substantially equal to that of said mandrel means bore;

said intermediate bore being contiguous with said upper bore and comprising a frusto-conically shaped passage defined by a sidewall diverging from the axis of said diffuser means; and said lower bore being contiguous with said intermediate bore and comprising a passage defined by a sidewall oriented at a non-diverging angle to the axis of said diffuser means.

2. The apparatus of claim 1 wherein said sidewall of said intermediate bore diverges at an angle of not more than substantially 3°.

3. The apparatus of claim 1 wherein said non-diverging angle is a 0° angle.

4. The apparatus of claim 1 wherein said non-diverging angle is a converging angle.

5. The apparatus of claim 4 wherein said converging angle is not more than substantially −0.5°.

6. The apparatus of claim 4 wherein said bore means further comprises a second intermediate bore disposed between and contiguous with said intermediate bore and said lower bore, said second intermediate bore comprising a cylindrical passage defined by a sidewall parallel to the axis of said diffuser means.

7. The apparatus of claim 6 wherein said converging angle is not more than substantially −1.0°.

8. A diffuser means for injection of fluid under pressure into a well conduit, comprising:

a substantially cylindrical diffuser body adapted to receive said fluid from a fluid source into bore means therethrough, which bore means directs said fluid into said well conduit, said bore means comprising an upper bore, an intermediate bore, and a lower bore;

said upper bore comprising a cylindrical passage;

said intermediate bore comprising a divergent frusto-conical passage coaxial and contiguous with said upper bore; and said lower bore comprising a non-divergent passage coaxial and contiguous with said intermediate bore.

9. The apparatus of claim 8 wherein said divergent frusto-conical passage possesses an apical angle of not more than substantially 6°.

10. The apparatus of claim 8 wherein said non-divergent passage is cylindrical.

11. The apparatus of claim 8 wherein said non-divergent passage comprises a convergent frusto-conical passage.

12. The apparatus of claim 11 wherein said convergent frusto-conical passage possesses an apical angle of not more than substantially 1°.

13. The apparatus of claim 11 wherein said bore means further comprises a second intermediate bore disposed between and coaxial and contiguous with said intermediate bore and said lower bore, said second intermediate bore comprising a cylindrical passage.

14. The apparatus of claim 13 wherein said convergent frusto-conical passage possesses an apical angle of not more than substantially 2.0°.

15. A wellhead isolation tool diffuser for the injection of treatment fluid under pressure into well bore tubing, comprising:

a cylindrical body adapted to receive said fluid under pressure into a bore therethrough which bore directs said fluid into said well bore tubing, said bore having upper, intermediate and lower sections, said upper section comprising a cylindrical passage, said intermediate section comprising a divergent passage, and said lower section comprising a non-divergent passage.

16. The apparatus of claim 15 wherein said divergent passage diverges at an angle of not more than substantially 3° to the axis of said diffuser.

17. The apparatus of claim 15 wherein said lower section comprises a cylindrical passage.

18. The apparatus of claim 15 wherein said lower section comprises a convergent passage.

19. The apparatus of claim 18 wherein said convergent passage converges at an angle of not more than substantially −0.5° to the axis of said diffuser.

20. The apparatus of claim 18 wherein said bore further comprises a second intermediate section between said intermediate and said lower sections, said second intermediate section comprising a cylindrical passage.

21. The apparatus of claim 20 wherein said convergent passage converges at an angle of not more than substantially −1.0° to the axis of said diffuser.

22. A wellhead isolation tool diffuser for the injection of treatment fluid under pressure into a conduit, comprising:

a cylindrical body adapted to receive said fluid under pressure into a bore therethrough and direct said fluid into said conduit, said bore having upper and lower sections, said upper section comprising a divergent passage and said lower section comprising a nondivergent passage.

23. The apparatus of claim 22 wherein said divergent passage diverges at an angle of not more than substantially 3° to the axis of said diffuser.

24. The apparatus of claim 22 wherein said lower section comprises a cylindrical passage.

25. The apparatus of claim 22 wherein said lower section comprises a convergent passage.

26. The apparatus of claim 25 wherein said convergent passage converges at an angle of not more than substantially −0.5° to the axis of said diffuser.

27. The apparatus of claim 25 wherein said bore further comprises an intermediate section between said upper and said lower sections, said intermediate section comprising a cylindrical passage.

28. The apparatus of claim 27 wherein said convergent passage converges at an angle of not more than substantially −1.0° to the axis of said diffuser.

* * * * *